US011614209B2

(12) United States Patent
Wu

(10) Patent No.: US 11,614,209 B2
(45) Date of Patent: Mar. 28, 2023

(54) DECORATIVE LIGHT BULB AND DECORATIVE LIGHT STRING

(71) Applicant: Qingbiao Wu, Fujian (CN)

(72) Inventor: Qingbiao Wu, Fujian (CN)

( * ) Notice: Subject to any disclaimer, the term of this patent is extended or adjusted under 35 U.S.C. 154(b) by 0 days.

(21) Appl. No.: 17/483,810

(22) Filed: Sep. 24, 2021

(65) Prior Publication Data

US 2023/0047982 A1 Feb. 16, 2023

(30) Foreign Application Priority Data

Aug. 13, 2021 (CN) ..... 202110932135.1

(51) Int. Cl.

| | |
|---|---|
| ***F21S 4/10*** | (2016.01) |
| ***F21V 23/02*** | (2006.01) |
| ***F21V 19/00*** | (2006.01) |
| ***F21W 121/00*** | (2006.01) |

(52) U.S. Cl.

CPC ..... *F21S 4/10* (2016.01); *F21V 19/0005* (2013.01); *F21V 23/023* (2013.01); *F21W 2121/00* (2013.01)

(58) Field of Classification Search

CPC ..... F21S 4/10; F21V 19/0005; F21V 23/023
See application file for complete search history.

(56) References Cited

U.S. PATENT DOCUMENTS

| | | | | |
|---|---|---|---|---|
| 6,273,590 | B1 * | 8/2001 | Splane, Jr. | F21V 17/02 362/346 |
| 7,118,249 | B2 * | 10/2006 | Hsu | F21V 21/08 362/249.06 |
| 7,311,425 | B2 * | 12/2007 | Jervey, III | F21V 27/00 362/406 |
| 8,721,107 | B2 * | 5/2014 | Cotzias | F21V 3/00 362/147 |
| 9,611,992 | B2 * | 4/2017 | Scales | H01R 33/94 |
| 9,752,763 | B2 * | 9/2017 | Lin | H02G 15/117 |
| 10,100,986 | B2 * | 10/2018 | Lin | F21V 27/00 |
| 10,309,591 | B2 * | 6/2019 | Lan | F21S 4/10 |
| 10,422,486 | B2 * | 9/2019 | Zhang | F21K 9/235 |
| 11,073,261 | B1 * | 7/2021 | Huang | F21V 1/00 |
| 2014/0265905 | A1 * | 9/2014 | Ray | F21K 9/232 315/210 |
| 2019/0338891 | A1 * | 11/2019 | Heil | F21V 23/001 |

* cited by examiner

*Primary Examiner* — Arman B Fallahkhair

(57) ABSTRACT

This invention provides a decorative light bulb including a lampshade, a lamp holder, a light source component, a power supply component, a lampshade base and a lamp holder base; a mounting part is inserted into the lampshade base, and the lamp holder base is inserted into the lamp holder; the power supply component comprises a pair of wires; a through hole is provided on the lampshade base and the lamp holder base for the wires to pass through. A decorative light string comprising a main cable, a plurality of bulb sockets and a plurality of decorative light bulbs is also provided, and the decorative light bulbs and the bulb sockets are correspondingly provided. The decorative light bulb of the present invention replaces conventional auxiliary cables with the wire, so that when the decorative light string is stored, the entanglement of the auxiliary cables and the main cable can be prevented.

9 Claims, 4 Drawing Sheets

DECORATIVE LIGHT BULB AND DECORATIVE LIGHT STRING

BACKGROUND OF THE INVENTION

The present invention relates to the technical field of decorative lighting and more particularly a decorative light bulb and a decorative light string.

Decorative light strings formed by decorative light bulbs can produce multiple little points of light sources when powered. They can be mounted on trees, models and other objects, thus providing excellent decoration during festive holidays and creating good festive atmosphere; as a result, they have become indispensable outdoor decoration items for domestic and international homes and shopping malls.

An existing decorative light string comprises a plurality of bulb sockets for receiving tungsten light bulbs which are connected in parallel to a main cable. Each of the bulb sockets are connected in suspension to the main cable through an auxiliary cable with a certain length. However, the tungsten filament of the tungsten light bulb will become thinner and thinner after using for a period of time. When the tungsten filament gets too thin, it would be burnt easily. Besides, the color of the tungsten light bulb is monotonous with only one color and lacking color variability. In addition, existing decorative light strings have the following problems when in use: as the main cable of a traditional decorative light string is connected in parallel to a plurality of auxiliary cables with a certain length, the main cable and the auxiliary cables are easily entangled with each other when it needs to be stored after use, and it is necessary to disentangle the entangled main cable and auxiliary cables before use, which brings great inconvenience to users. Moreover, because the auxiliary cables with a certain length are connected to the main cable in parallel, users cannot adjust the length and the position of the auxiliary cables according to their own preferences, resulting in monotonous style and bringing aesthetic visual fatigue to users.

BRIEF SUMMARY OF THE INVENTION

It is an object of the present invention to provide a decorative light bulb with simple structure and lower cost.

To attain this, the present invention adopts the following technical solution: a decorative light bulb comprising a lampshade, a lamp holder, a light source component and a power supply component which are electrically connected with each other and disposed inside the lampshade, and a connection structure for connecting the lampshade and the lamp holder; the lampshade comprises a lampshade body and a mounting part integrally connected to the lampshade body; the connection structure comprises a lampshade base and a lamp holder base; the mounting part is inserted into the lampshade base; the lamp holder base is inserted into the lamp holder; the power supply component comprises a pair of wires; a through hole is provided in each of the lampshade base and the lamp holder base for the wires to pass through; each of the wires has a first end which passes through the through hole in the lamp holder base to connect to the lamp holder; each of the wires has a second end which passes through the through hole in the lampshade base to electrically connect with the power supply component.

Preferably, the connection structure further comprises a connecting piece that fixes the wires to the lampshade base; the connecting piece comprises a screw bolt and a screw nut connected to the screw bolt; the screw bolt comprises a screw head and a screw rod connected to the screw head; the screw head is disposed on the lampshade base, and the screw head has a diameter which is larger than a diameter of the through hole in the lampshade base; the screw rod passes through the through hole in the lampshade base; the screw rod is provided with external screw threads on an outer side wall thereof, and the screw nut is provided with internal screw threads that correspond to the external screw threads of the screw rod on an inner wall thereof.

Preferably, the screw bolt is provided with a through hole for the wires to pass through; the through hole runs through the screw head and the screw rod; the wires pass through the through hole.

Preferably, it further comprises a transparent base disposed in the lampshade; the power supply component further comprises a power supply board and an electronic component that are mounted on the transparent base; the light source component comprises a rigid conductive strip passing through the transparent base and connected to the power supply board, and an LED filament fixedly connected to the rigid conductive strip; the electronic component has a first end which is electrically connected to the power supply board and a second end which is connected to the LED filament.

Preferably, a positioning slot is opened at a first end of the transparent base which is distant from the lamp holder; two mounting holes are opened at a bottom of the positioning slot for the electronic component and the rigid conductive strip to pass through respectively; the rigid conductive strip comprises a filament connection section that connects to the LED filament and a power connection section that connects to the power supply board; the power connection section passes through a respective one of the mounting holes.

Preferably, an inner hole is opened at a second end of the transparent base which is not provided with the positioning slot; the mounting holes are connected with the inner hole; the power supply board is positioned in the inner hole and is provided with positioning holes; the inner hole is provided with positioning posts that cooperate with the positioning holes.

Preferably, a limiting structure is provided at the rigid conductive strip at a position near the positioning slot for preventing the rigid conductive strip from axial rotation; the limiting structure is mounted in the positioning slot; the limiting structure and the rigid conductive strip are integrally formed.

Preferably, it further comprises a first sealing ring and a second sealing ring; the first sealing ring is sleeved on the mounting part; the second sealing ring is sleeved on the screw rod.

By adopting the aforementioned design, the beneficial effects of the present invention include: by replacing traditional tungsten light bulbs with LED light bulbs, the disadvantages of traditional tungsten light bulbs, such as being easily burnt and having monotonous color, are overcome; by adding a connection structure between the lampshade and the lamp holder and connecting the lampshade base and the lamp holder base by the wires, users are allowed to set the length of the wires according to their own preferences and then mount the decorative light bulbs of the present invention to the light strings, so that the light strings equipped with the decorative light bulbs are suitable for more occasions and become more interesting; by replacing the conventional auxiliary cables with the wires, when the decorative light strings are stored, the entanglement of the auxiliary cables and the main cable can be prevented, and storage is easier if the auxiliary cables (i.e. the wires) are arranged on the decorative light bulb.

Another object of the present invention is to provide a decorative light string which is convenient and quick to disassemble and assemble, and the main cable and auxiliary cables are not easily entangled.

To attain this, the present invention adopts the following technical solution: a decorative light string comprising a main cable, a plurality of bulb sockets connected in parallel to the main cable and a plurality of decorative light bulbs; the decorative light bulbs and the bulb sockets are correspondingly provided; each of the decorative light bulbs is the aforementioned decorative light bulb.

Preferably, two ends of the main cable are respectively fixedly connected with a head connector and a tail connector; the head connector is connected to a power supply, or connected to the tail connector of a connected main cable.

By adopting the aforementioned design, the beneficial effects of the present invention include: by replacing the conventional auxiliary cables with the wires of the decorative light bulbs, the problem that the traditional light strings are easily entangled is solved; when the decorative light strings are stored, the entanglement of the auxiliary cables and the main cable can be prevented; providing the auxiliary cables on the decorative light bulbs makes storage easier, while the cost is lower and the process is simpler as the main cable is manufactured without the auxiliary cables; furthermore, users can adjust the length of the wires on the decorative light bulbs according to their own preferences, so that the style of the decorative light bulbs on the entire light string can be changed at will, and thus the light strings equipped with the decorative light bulbs are suitable for more occasions and become more interesting; when the decorative light bulbs of the present invention are separated from the decorative light strings, the decorative light bulbs are easier to store and more convenient to transport.

In the figures: 1 denotes the lampshade; 11 denotes the lampshade body; 12 denotes the mounting part, 2 denotes the lamp holder, 3 denotes the transparent base, 31 denotes the positioning slot, 311 denotes the first mounting hole, 312 denotes the second mounting hole, 32 denotes the inner hole, 321 denotes the positioning post, 4 denotes the lampshade base, 41 denotes the first through hole, 5 denotes the lamp holder base, 51 denotes the clamping part, 52 denotes the second through hole, 6 denotes the connecting piece, 61 denotes the screw bolt, 611 denotes the screw head, 612 denotes the screw rod, 613 denotes the through hole, 62 denotes the screw nut, 71 denotes the first wire, 711 denotes the first connection end, 712 denotes the second connection end, 72 denotes the second wire, 73 denotes the electronic component, 74 denotes the power supply board, 741 denotes the positioning hole, 81 denotes the rigid conductive strip, 811 denotes the filament connection section, 812 denotes the power connection section, 813 denotes the limiting structure, 82 denotes the LED filament, 91 denotes the first sealing ring, 92 denotes the second sealing ring, 10 denotes the main cable, 20 denotes the bulb socket, 30 denotes the decorative light bulb, 40 denotes the head connector, 50 denotes the tail connector.

DETAILED DESCRIPTION OF THE INVENTION

The following describes the technical solutions in the exemplary embodiments of the present invention with reference to the accompanying drawings. Obviously, the exemplary embodiments described herein are only some of the embodiments of the present invention but not all. Based on the exemplary embodiments of the present invention, all other embodiments obtained by those of ordinary skill in the art without creative labor shall fall within the protection scope of the present invention.

Figure 1:
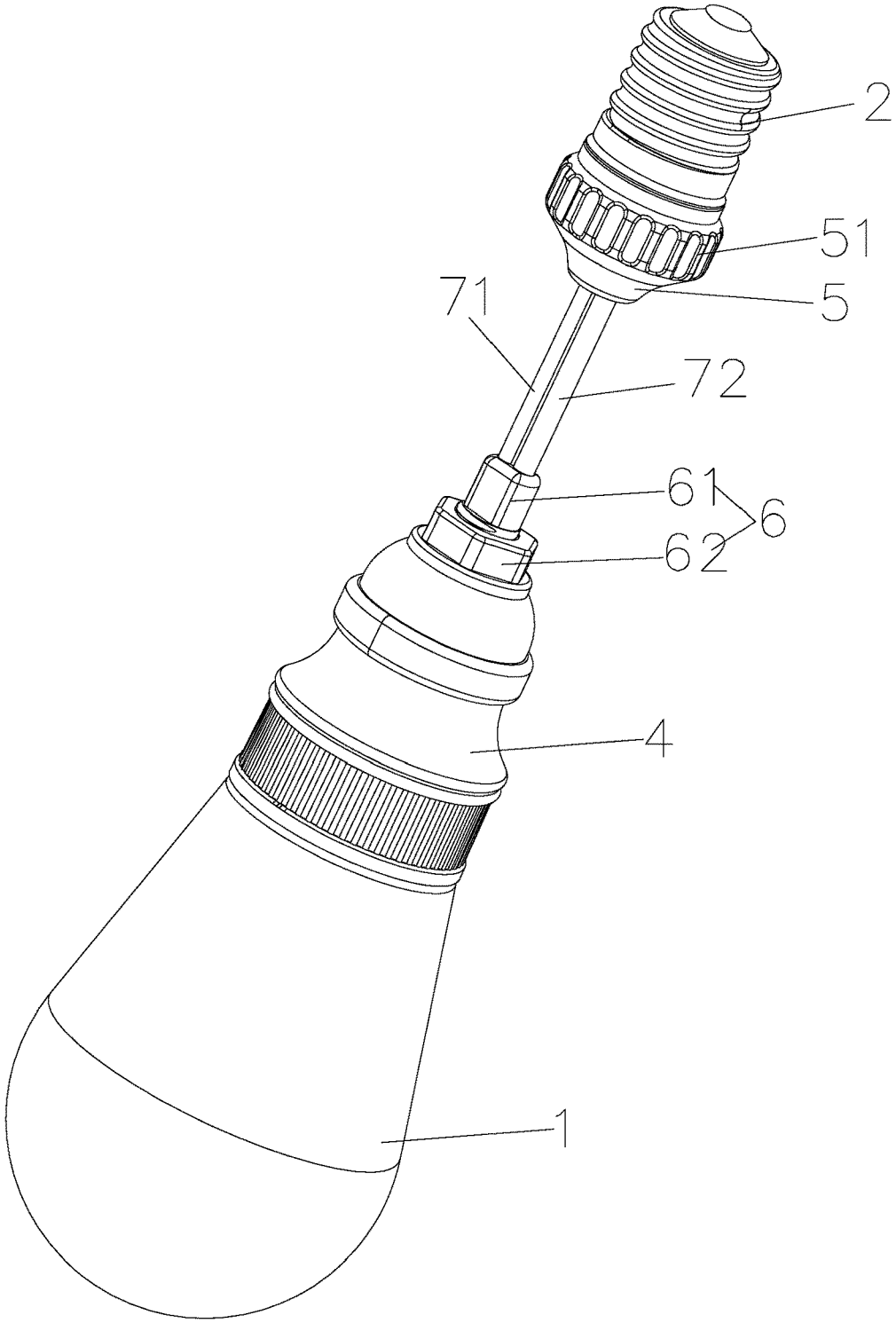
FIG. 1 shows a schematic diagram of the decorative light bulb in the present invention.
Figure 2:
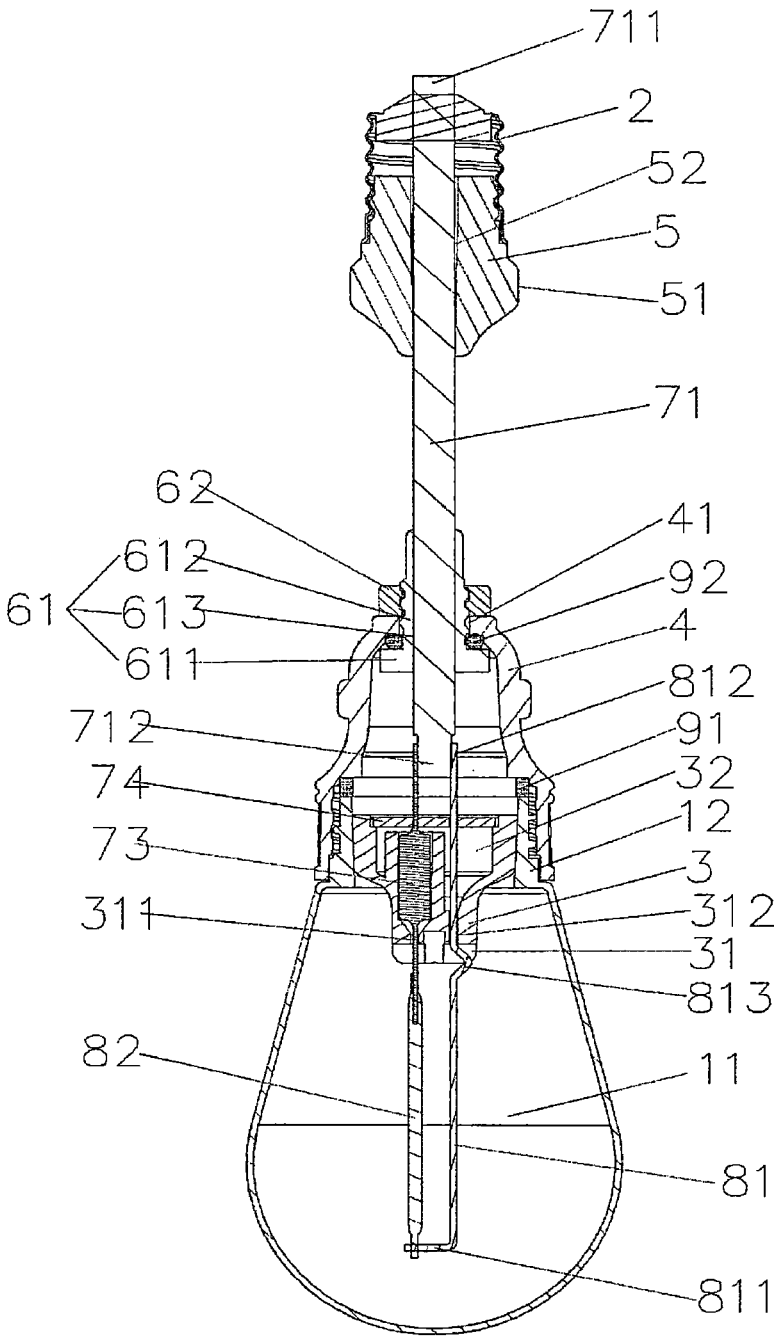
FIG. 2 shows a sectional view of the decorative light bulb in the present invention.
Figure 3:
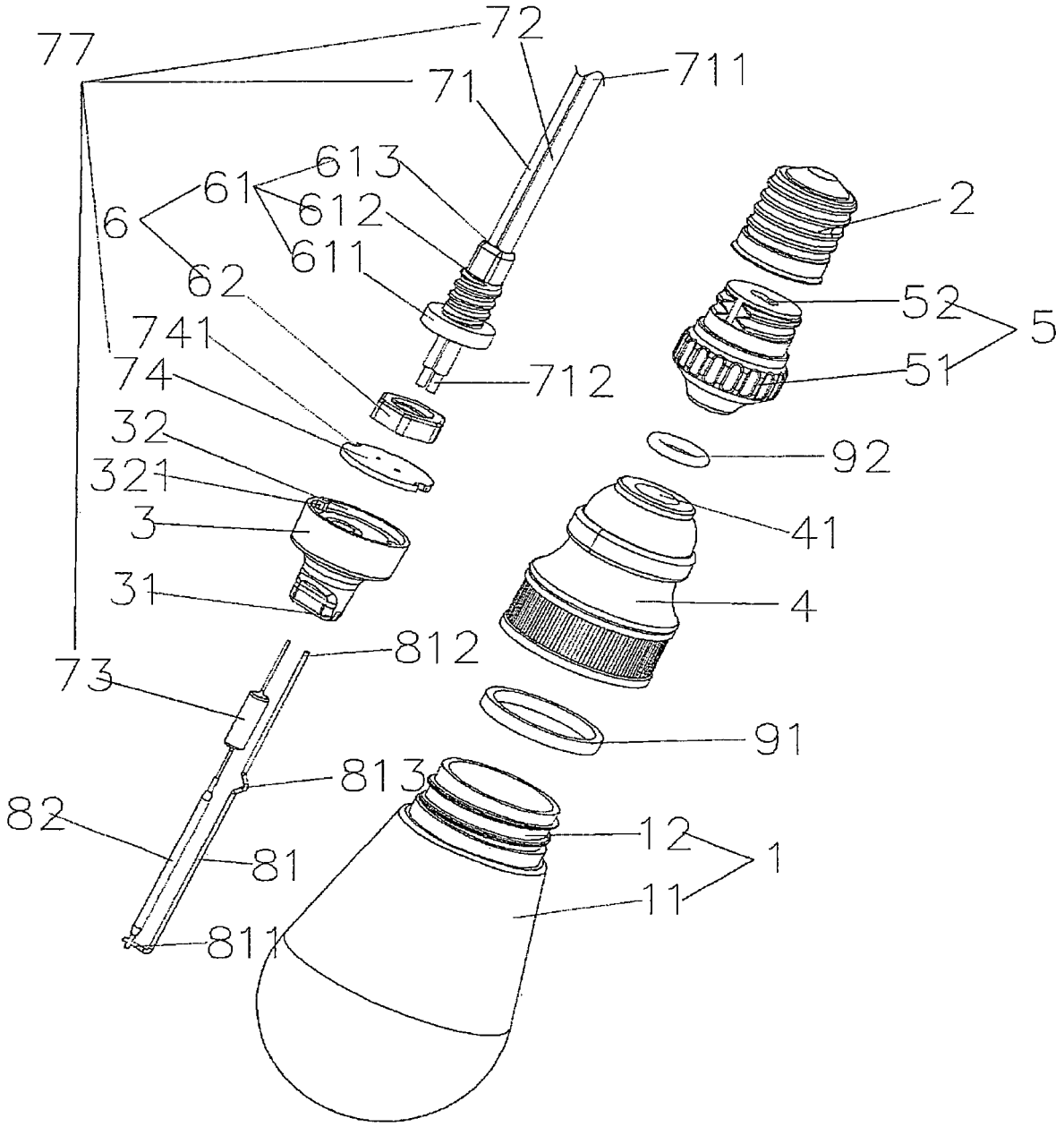
FIG. 3 shows an exploded view of the decorative light bulb in the present invention.

As illustrated in FIGS. 1-3, this exemplary embodiment provides a decorative light bulb comprising a lampshade 1, a lamp holder 2, a connection structure 111 for connecting the lampshade 1 and the lamp holder 2, a light source component and a power supply component which are electrically connected with each other and disposed inside the lampshade 1, and a transparent base 3 disposed in the lampshade 1. The connection structure 111 comprises a lampshade base 4, a lamp holder base 5, and a connecting piece 6 that fixes a first wire 71 (will be described in detail below) and a second wire 72 (will be described in detail below) to the lampshade base 4. The lampshade 1, the transparent base 3, the lampshade base 4, the lamp holder base 5 and the connecting piece 6 are made of plastic, thereby enhancing the anti-fall performance of the decorative light bulb and avoiding using open fire during manufacture (plastic parts can be formed by blow-molding or injection molding). Notably, the light source component of this exemplary embodiment is a light source component commonly used in the market, and the power supply component of this exemplary embodiment is also a power supply component commonly used in the market.

The lampshade 1 comprises a lampshade body 11 and a mounting part 12 integrally connected to the lampshade body 11. The mounting part 12 is inserted into the lampshade base 4. The lamp holder base 5 is inserted into the lamp holder 2. The shape of the lampshade body 11 of the lampshade 1 which is not inserted into the lampshade base 4 is the same as the shape of the lampshade of a traditional tungsten light bulb, and the specific shape can be designed according to actual needs. Specifically, when the lampshade 1 is formed by injection molding, external screw threads are formed on an outer side wall of the mounting part 12, and internal screw threads which correspond to the external screw threads of the mounting part 12 are formed on an inner side of the lampshade base 4, so that the lampshade 1 and the lampshade base 4 are threadedly locked together. The lamp holder 2 is a screw lamp holder used for traditional tungsten bulbs, and its main body is usually obtained by compression molding with a metal sleeve; thus, when external screw threads are formed on the lamp holder 2, internal screw threads are naturally formed on an inner side of the lamp holder 2. The lamp holder base 5 is provided with external screw threads that correspond to the internal screw threads of the lamp holder 2, so that the lamp holder 2 and the lamp holder base 5 are threadedly locked together. Besides, a first sealing ring 91 is sleeved between the outer side wall of the mounting part 12 of the lampshade 1 and an inner side wall of the lampshade base 4. The first sealing ring 91 is made of silica gel to form a seal with good waterproof performance that effectively improves the waterproof ability of the light bulb.

Furthermore, a clamping part 51 is provided on a side of the lamp holder base 5 which is close to the lampshade 1 to facilitate holding by hand or clamping and rotating by mechanical arms.

The power supply component 77 comprises the first wire 71, the second wire 72, and an electronic component 73 and a power supply board 74 that are mounted on the transparent base 3. The light source component comprises a rigid conductive strip 81 passing through the transparent base 3 and electrically connected to the power supply board 74, and an LED filament 82 fixedly connected to the rigid conductive strip 81. Each of the first wire 71 and the second wire 72 comprises a first connection end 711 connected to a power source and a second connection end 712 connected to the power supply board 74. Notably, the first connection end 711 of the first wire 71 can be connected to the neutral wire of the mains, and the first connection end 711 of the second wire 72 can be connected to the live wire of the mains. Moreover, the first wire 71, the second wire 72, the electronic component 73 and the power supply board 74 in this exemplary embodiment are alt conventional components and are therefore not detailed herein.

The lampshade base 4 is provided with a first through hole 41 for the second connection end 712 of the first wire 71 and the second connection end 712 of the second wire 72 to pass through. The second connection end 712 of the first wire 71 and the second connection end 712 of the second wire 72 respectively pass through the first through hole 41 and connect to the power supply board 74. The lamp holder base 5 is provided with a second through hole 52 for the first connection end 711 of the first wire 71 and the first connection end 711 of the second wire 72 to pass through. The first connection end 711 of the first wire 71 and the first connection end 711 of the second wire 72 respectively pass through the second through hole 52 and connect to the lamp holder 2.

The connecting piece 6 comprises a screw bolt 61 and a screw nut 62 connected to the screw bolt 61. The screw bolt 61 comprises a screw head 611 and a screw rod 612 connected to the screw head 611. The screw head 611 is disposed on the lampshade base 4, and the screw head 611 has a diameter which is larger than a diameter of the first through hole 41. The screw rod 612 is provided with external screw threads on an outer side wall thereof, and the screw nut 62 is provided with internal screw threads that correspond to the external screw threads of the screw rod 612 on an inner wall thereof. The screw rod 612 passes through the first through hole 41 and connects to the screw nut 62. The screw bolt 61 is provided with a through hole 613 for the first wire 71 and the second wire 72 to pass through. The first wire 71 and the second wire 72 respectively pass through and extend out of the through hole 613. The first wire 71 and the second wire 72 are fixed on the lampshade base 4 by means of the threaded cooperation between the screw bolt 61 and the screw nut 62, which is convenient to disassemble. In addition, a second sealing ring 92 is sleeved between the outer side wall of the screw rod 612 and the inner side wall of the lampshade base 4. Specifically, the second sealing ring 92 is made of silica gel to form a seal with good waterproof performance, which effectively improves the waterproof ability of the light bulb.

Furthermore, a positioning slot 31 is opened at a first end of the transparent base 3 which is distant from the lamp holder 2. The positioning slot 31 is arranged in a straight line parallel to a radial direction of the lamp holder 2. A first mounting hole 311 for the electronic component 73 to pass through and a second mounting hole 312 for the rigid conductive strip 81 to pass through are opened at a bottom of the positioning slot 31. Specifically, in this exemplary embodiment, the electronic component 73 can be a conventional resistor in the market, and a first leg of the resistor passes through the first mounting hole 311 and connects to the LED filament 82, while a second leg of the resistor is electrically connected to the power supply board 74. The rigid conductive strip 81 comprises a filament connection section 811 that connects to the LED filament 82 and a power connection section 812 that connects to the power supply board 74. The power connection section 812 passes through the second mounting hole 312 and connects to the power supply board 74.

Furthermore, a limiting structure 813 is provided at a position near the positioning slot 31 for preventing the rigid conductive strip 81 from radially moving and axially rotating towards the lamp holder 2. The limiting structure 813 is mounted in the positioning slot 31, and the limiting structure 813 and the rigid conductive strip 81 are integrally formed. Specifically, the limiting structure 813 can be formed by stamping grooves (i.e. the limiting structures 813) along a radial direction of the rigid conductive strip 81, so that the limiting structure 813 is formed on a corresponding position of the rigid conductive strip 81. Thereby, the mechanical performance and mechanical structure performance of the overall rigid conductive strip 81 are improved; not only the rigidity of the limiting structure 813 is strengthened, but also the limiting structure 813 is mounted in the positioning slot 31 at the same time, thus effectively preventing the rotation and movement of the rigid conductive strip 81.

An inner hole 32 is opened at a second end of the transparent base 3 which is not provided with the positioning slot 31, and the first mounting hole 311 and the second mounting hole 312 are respectively connected with the inner hole 32. The power supply board 74 can be a power supply board used by conventional LED bulbs, which is positioned in the inner hole 32. Preferably, the power supply board 74 provided in this exemplary embodiment is provided with positioning holes 741 on the basis of a conventional power supply board, and the inner hole 32 is provided with positioning posts 321 that cooperate with the positioning holes 741, so as to achieve the connection between the transparent base 3 and the power supply board 74. Certainly, if necessary, snapping structure can also be provided on the positioning posts 321, the details of which are not provided herein. Moreover, the second end of the transparent base 3 that is not provided with the positioning slot 31 has an outer diameter which correspond to a diameter of the mounting part 12; the two are preferably in interference fit to achieve a fixed connection and effectively improve the waterproof ability of the light bulb, the details of which are not provided herein.

In this exemplary embodiment, the lamp holder 2 and the lamp holder base 5 are detachably connected by threaded connection. The first connection end 711 of the first wire 71 and the first connection end 711 of the second wire 72 are detachably arranged in the second through hole 51 by means of interference fit; the second connection end 712 of the first wire 71 and the second connection end 712 of the second wire 72 are detachably arranged in the through hole 613 by means of interference fit; the first wire 71 and the second wire 72 are fixed on the lampshade base 4 by cooperation between the screw bolt 61 and the screw nut 62. When the LED filament 82 does not light up because of the damage of the first wire 71, the second wire 72, the electronic component 73, the power supply board 74 or the LED filament 82, the light bulb can be restored by replacing the corresponding part only, which makes the other parts of the light bulb reusable, thus attaining environmentally friendliness and avoiding waste.

By adopting the aforementioned design, the beneficial effects of the present invention include:

1. By replacing traditional tungsten light bulbs with LED light bulbs, the disadvantages of traditional tungsten light bulbs, such as being easily burnt and having monotonous color, are overcome;

2. By adding a connection structure between the lampshade 1 and the lamp holder 2, the first wire 71 and the second wire 72 connect the lampshade base 4 and the lamp holder base 5, which allows the users to set the length of the first wire 71 and the second wire 72 according to their own preferences; after the decorative light bulbs of the present invention are installed on the light strings, the light strings equipped with the decorative light bulbs are suitable for more occasions and become more interesting;

3. By replacing the conventional auxiliary cables with the first wire 71 and the second wire 72, when the decorative light strings are stored, the entanglement of the auxiliary cables and the main cable can be prevented; storage is easier if the auxiliary cables (i.e. the first wire 71 and the second wire 72) are arranged on the decorative light bulb;

4. The lamp holder 2 and the lamp holder base 5 are detachably connected by threaded connection; the first connection end 711 of the first wire 71 and the first connection end 711 of the second wire 72 are detachably arranged in the second through hole 51 by means of interference fit; the second connection end 712 of the first wire 71 and the second connection end 712 of the second wire 72 are detachably arranged in the through hole 613 by means of interference fit; the first wire 71 and the second wire 72 are fixed on the lampshade base 4 by cooperation between the screw bolt 61 and the screw nut 62. When some parts of the present invention are damaged, the light bulb can be restored by replacing the corresponding parts only, which makes the other parts of the light bulb reusable, thus attaining environmentally friendliness and avoiding waste.

5. The lampshade 1, the transparent base 3, the lampshade base 4, the lamp holder base 5 and the connecting piece are made of plastic which is difficult to break; they could also be formed by blow-molding or injection molding so that open fire is not required, thus achieving higher production safety and lower cost;

6. By providing external screw threads on the mounting part 12 and the lamp holder base 5, the connection between the lampshade 1 and the lampshade base 4 as well as between the lamp holder 2 and the lamp holder base 5 is more secured;

7. By providing the first sealing ring 91 on the outer side wall of the mounting part 12 and the second sealing ring 92 on the outer side wall of the screw rod 612, the waterproof ability of the light bulb is effectively improved.

Figure 4:
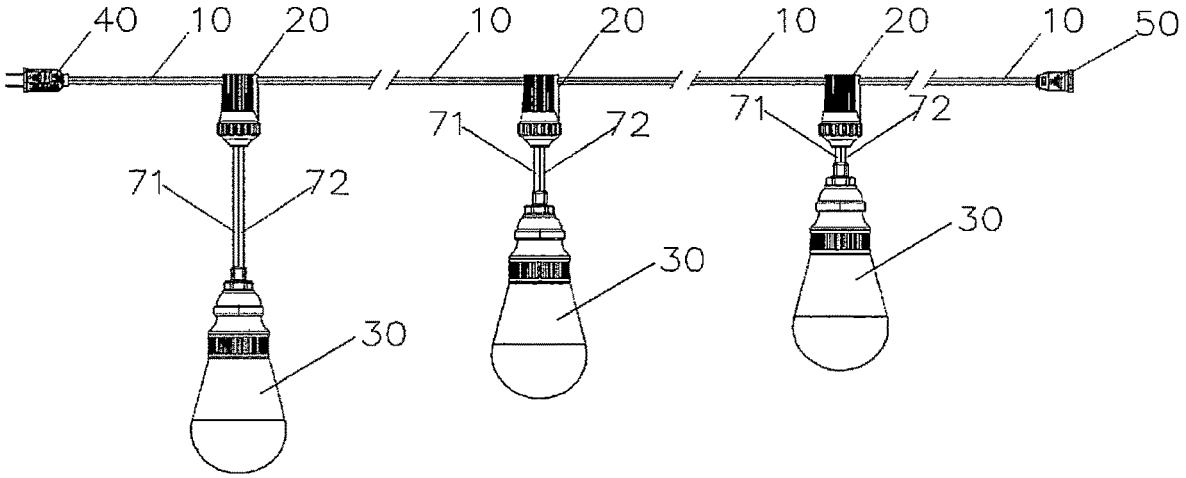
FIG. 4 shows a schematic diagram of the decorative light string in the present invention.

As illustrated in FIG. 4, this exemplary embodiment also provides a decorative light string comprising a main cable 10, a plurality of bulb sockets 20 connected in parallel to the main cable 10, and a plurality of decorative light bulbs 30 (the decorative light bulb provided above). The decorative light bulbs 30 and the bulb sockets 20 are correspondingly provided, with a lamp holder (not shown in the figure) of each of the decorative light bulbs 30 inserted to the corresponding bulb socket 20. The length of the first wire 71 and the second wire 72 of each of the decorative light bulbs 30 can be set the same or different according to the users' preference. The bulb sockets 20 are conventional components and are not detailed herein.

Two ends of the main cable 10 are respectively fixedly connected with a head connector 40 and a tail connector 50. The head connector 40 can be electrically connected to the power supply, or electrically connected to the tail connector 50 of a connected main cable 10, so as to lengthen the length of the whole string of decorative lights and allow multiple light string structures to be connected in series or parallel, which is suitable for the arrangement of decorative lights and convenient to use. By connecting the head connector 40 to the mains, the main cable 10 transmits electric energy to each of the decorative light bulbs 30 to illuminate the decorative light bulbs 30; such decorative light bulbs 30 are easy to assemble and provide good luminous and decorative effects.

By adopting the aforementioned design, the beneficial effects of the present invention include:

1. By replacing the conventional auxiliary cables with the first wire 71 and the second wire 72 of the decorative bulbs 30, the entanglement problem of traditional light strings is solved; when the decorative light strings are stored, the main cable 10 would not entangle with the auxiliary cables;

2. Providing the auxiliary cables (i.e. the first wire 71 and the second wire 72) on the decorative light bulbs 30 makes storage easier, while the cost is lower and the process is simpler as the main cable 10 is manufactured without the auxiliary cables. Furthermore, users can adjust the length of the first wire 71 and the second wire 72 on the decorative light bulbs 30 according to their own preferences, so that the style of the decorative light bulbs 30 on the entire light string can be changed at will, and thus the light strings equipped with decorative light bulbs are suitable for more occasions and become more interesting;

3. When the decorative light bulbs 30 of the present invention are separated from the decorative light strings, the decorative light bulbs 30 are easier to store and more convenient to transport.

Although some embodiments of the present invention have been described above, a person skilled in the art may make other changes, modifications, substitutions and variations based on the described embodiments without departing from the principles and spirits of the present invention. The scope of the present invention is defined by the accompanying claims and equivalents thereof.

What is claimed is:

1. A decorative light bulb comprising a lampshade, a lamp holder, a light source component and a power supply component which are electrically connected with each other and disposed inside the lampshade; the lampshade comprises a lampshade body and a mounting part integrally connected to the lampshade body, characterized in that: it further comprises a connection structure for connecting the lampshade and the lamp holder; the connection structure comprises a lampshade base and a lamp holder base; the mounting part is inserted into the lampshade base; the lamp holder base is inserted into the lamp holder; the power supply component comprises a pair of wires; a through hole is provided in each of the lampshade base and the lamp holder base for the wires to pass through; each of the wires has a first end which passes through the through hole in the lamp holder base to connect to the lamp holder; each of the wires has a second end which passes through the through hole in the lampshade base to electrically connect with the power supply component; the connection structure further comprises a connecting piece that fixes the wires to the lampshade base; the connecting piece comprises a screw bolt and a screw nut connected to the screw bolt; the screw bolt comprises a screw head and a screw rod connected to the screw head; the screw head is disposed on the lampshade base, and the screw head has a diameter which is larger than a diameter of the through hole in the lampshade base; the screw rod passes through the through hole in the lampshade base; the screw rod is provided with external screw threads on an outer side wall thereof, and the screw nut is provided with internal screw threads that correspond to the external screw threads of the screw rod on an inner wall thereof.

2. The decorative light bulb as in claim 1, characterized in that: it further comprises a transparent base disposed in the lampshade; the power supply component further comprises a power supply board and an electronic component that are mounted on the transparent base; the light source component comprises a rigid conductive strip passing through the transparent base and connected to the power supply board, and an LED filament fixedly connected to the rigid conductive strip; the electronic component has a first end which is electrically connected to the power supply board and a second end which is connected to the LED filament.

3. The decorative light bulb as in claim 2, characterized in that: a positioning slot is opened at a first end of the transparent base which is distant from the lamp holder; two mounting holes are opened at a second end of the transparent base opposite to the positioning slot for the electronic component and the rigid conductive strip to pass through respectively; the rigid conductive strip comprises a filament connection section that connects to the LED filament and a power connection section that connects to the power supply board; the power connection section passes through a respective one of the mounting holes.

4. The decorative light bulb as in claim 3, characterized in that: an inner hole is opened at a second end of the transparent base which is not provided with the positioning slot; the mounting holes are connected with the inner hole; the power supply board is positioned in the inner hole and is provided with positioning holes; the inner hole is provided with positioning posts that cooperate with the positioning holes.

5. The decorative light bulb as in claim 3, characterized in that: a limiting structure is provided at the rigid conductive strip at a position near the positioning slot for preventing the rigid conductive strip from axial rotation; the limiting structure is mounted in the positioning slot; the limiting structure and the rigid conductive strip are integrally formed.

6. A decorative light string, characterized in that: it comprises a main cable, a plurality of bulb sockets connected in parallel to the main cable, and a plurality of decorative light bulbs; the decorative light bulbs and the bulb sockets are correspondingly provided; each of the decorative light bulbs is the decorative light bulb as in claim 1.

7. The decorative light string as in claim 6, characterized in that: two ends of the main cable are respectively fixedly connected with a head connector and a tail connector; the head connector is connected to a power supply, or connected to the tail connector of a connected main cable.

8. The decorative light bulb as in claim 1, characterized in that: the screw bolt is provided with a through hole for the wires to pass through; the through hole runs through the screw head and the screw rod; the wires pass through the through hole.

9. The decorative light bulb as in claim 1, characterized in that: it further comprises a first sealing ring and a second sealing ring; the first sealing ring is sleeved on the mounting part; the second sealing ring is sleeved on the screw rod.

* * * * *